United States Patent [19]

Sushan

[11] 4,130,311

[45] Dec. 19, 1978

[54] DOOR JAMB GUARD

[76] Inventor: Frank M. Sushan, 1422 Hayes St., Apt. 8, Hollywood, Fla. 33020

[21] Appl. No.: 840,604

[22] Filed: Oct. 11, 1977

Related U.S. Application Data

[62] Division of Ser. No. 677,776, Apr. 16, 1976, abandoned.

[51] Int. Cl.[2] ..... E05B 17/00

[52] U.S. Cl. ..... 292/346

[58] Field of Search ..... 292/346

[56] References Cited

U.S. PATENT DOCUMENTS 3,405,962 10/1968 Sushan ..... 292/346

FOREIGN PATENT DOCUMENTS 10185 of 1928 Australia ..... 292/346

979051 12/1975 Canada ..... 292/346

*Primary Examiner*—Kenneth J. Dorner

*Attorney, Agent, or Firm*—Malin & Haley

[57] ABSTRACT

Improved lock blocking plates and door jamb striker plates for use with entrance doors, the plates being utilized to prevent forcing or jacking open of dead bolt or spring bolt latches, together or singularly, while preventing inclement weather elements including rain water and wind from being received into the space existing between the door end face and the door jamb. The invention includes several alternate embodiments for uses with single doors that open in or out and double doors and provide for rain drainage, wind and rain deflection and a guard plate to prevent unauthorized opening of a dead bolt or spring latch bolt found in conventional doors and door jambs. Also included in the improvements is a downward and outward angularly formed top guard plate edge which allows rain water which might otherwise seep into the locking mechanism to drain outwardly and downwardly for preventing moisture in the lock operating mechanism. An additional improvement includes the utilization of full length interlocking door guard strips having an outer deflector surface to divert wind driven rain away from the door jamb spacing of the entrance doors.

1 Claim, 14 Drawing Figures

Fig. 2.
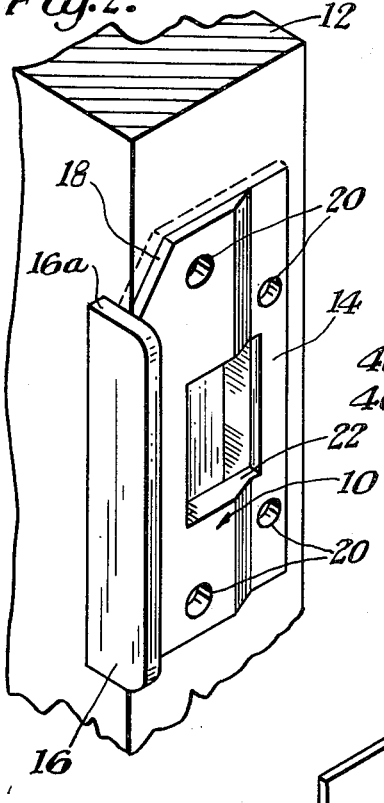
Fig. 5.
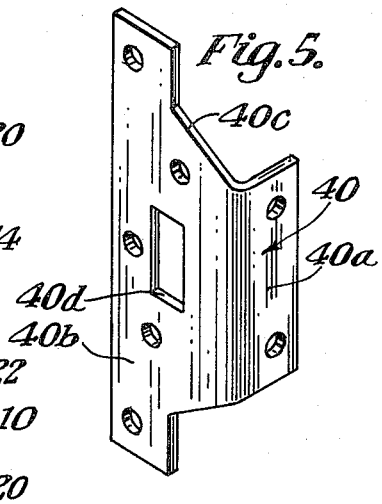
Fig. 1.
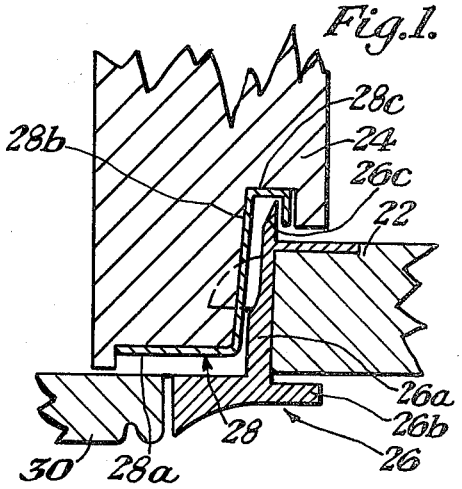
Fig. 7A.
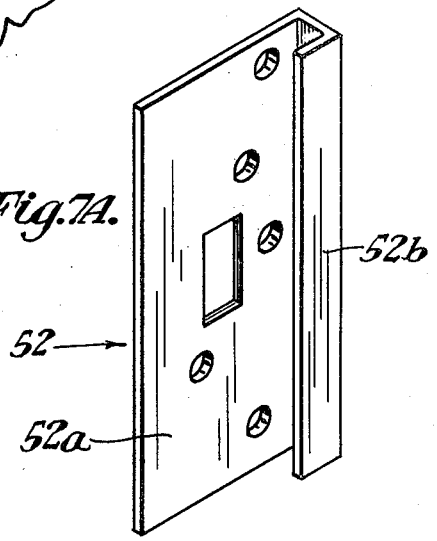
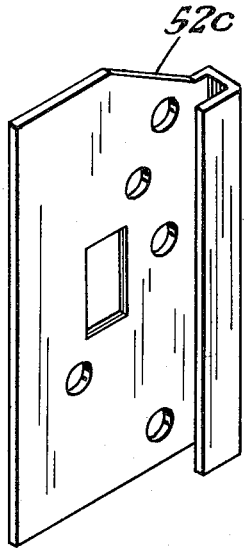
Fig. 7B.
Fig. 8.
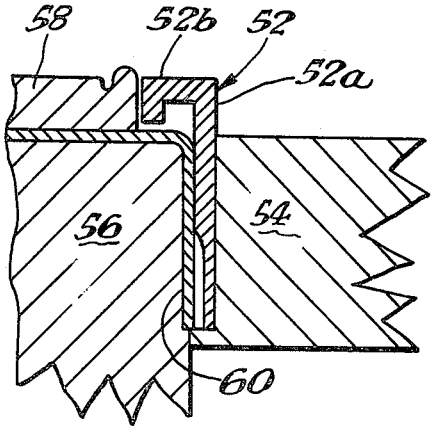

Fig. 9.
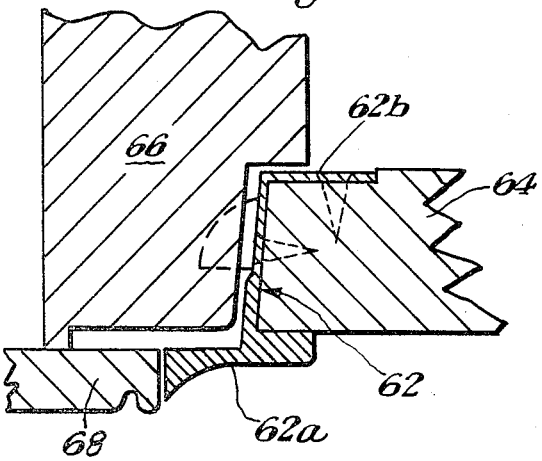
Fig. 3.
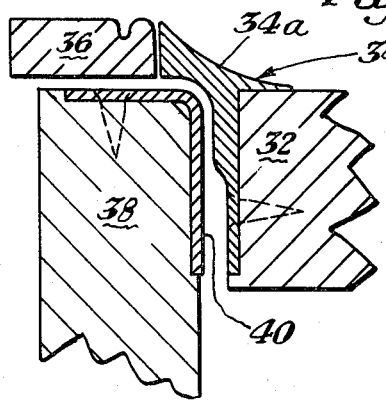
Fig. 4.
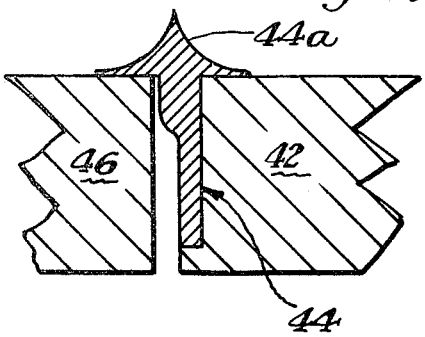
Fig. 6.
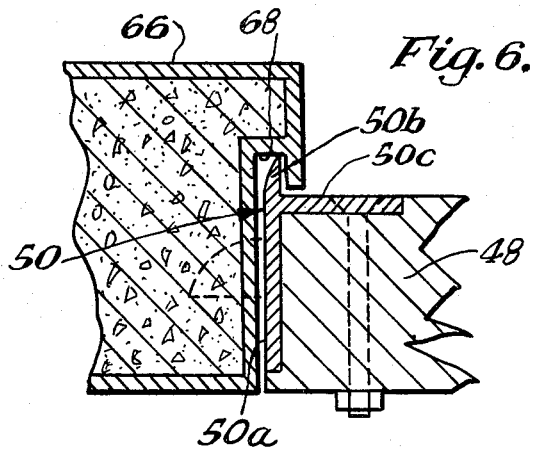
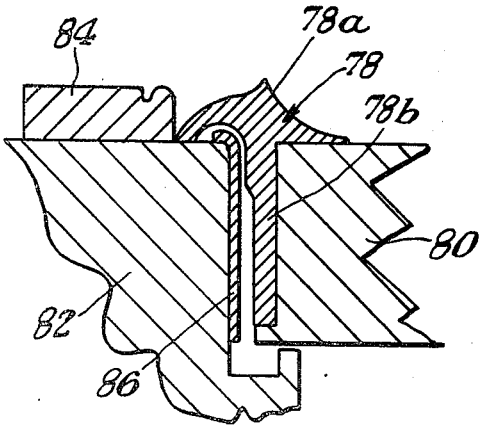
Fig. 11.
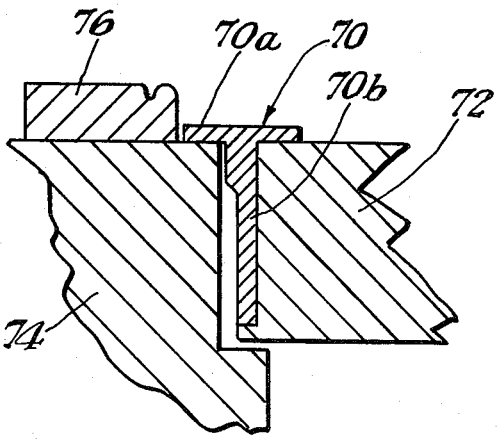
Fig. 10.

DOOR JAMB GUARD

This is a division of application Ser. No. 677,776, filed Apr. 16, 1976 now abandoned.

This invention involves improvements over those described in the present Applicant's prior U.S. Pat. Nos. 3,290,081 and 3,405,962, which are directed toward various types of door lock guards which prevent the unauthorized opening of a door lock by protecting the door lock spring latch bolt against jimmying, prying or jacking from one or both sides of the door. This invention improves U.S. Pat. No. 3,290,081 for preventing entries when doors open inwardly by altering channel section for use as weather strip on doors that open out, and improving U.S. Pat. No. 3,405,962 to protect entrance doors that open outwardly, making possible the use of these units for doors that open in when installed on jambs which have the door stop attached to the jamb with screws or nails.

BRIEF DESCRIPTION OF THE INVENTION

The invention is comprised of improved lock blocking plates and door jamb striker plates for use with conventional entrance doors, the purpose of the plates being to prevent unauthorized entry through the doors by jimmying or prying the spring latch bolt of a conventional door lock while preventing inclement weather elements, such as rain and wind, from being received into the door jamb space and the door lock mechanism while providing a drain-off of rain in particular embodiments. The present invention includes an improvement of Applicant's prior patents, U.S. Pat. Nos. 3,290,081 and 3,405,962, the disclosure of which is hereby incorporated into this application. The present invention includes modification of the blocking or guard plate or the door jamb striker plate which provides in one embodiment for an angularly disposed front surface edge which faces outward from the interior of the dwelling which provides an inclined surface to allow the run-off of water, such as from rain, received into or around the door jamb space. The present invention, in another embodiment, also includes a weather strip deflection surface mounted on an exterior door of the building, the deflection plate causing wind and rain to be deflected away from the space between the door and the door jamb itself. This embodiment prevents the deterioration of the locking mechanism itself by preventing moisture from being received within the mechanism housing. Another embodiment disclosed in this application is the use of a sharply edged or knife-edged guard flange protruding from the door lock blocking plate with the flange being sharp enough to be driven into a wooden door jamb to provide a guard plate in the jamb which prevents a sharp instrument from being driven between the door jamb and door stop to reach the spring latch bolt. This embodiment also discloses a similar flange plate which is mounted behind an exterior molding strip such that it is hidden from view but prevents the driving of a sharp tool through the jamb itself, again to prevent someone from engaging the spring latch bolt by driving a sharp tool through the jamb. The remaining embodiments provide for interlocking, of either or both, door lock blocking plates and door jamb striker plates which may be utilized with doors opening either inwardly or outwardly.

It is an object of this invention to provide an improved assembly of interlocking and single unit door jamb attachments for use with any conventional spring bolt lock set to provide dead bolt protection against unauthorized entries by jimmying, forcing or jacking door latch bolts open regardless whether the door opens outwardly or inwardly, while protecting against inclement weather conditions by deflecting or diverting wind and water away from the door jamb space and the locking mechanism.

It is another object of this invention to provide an improved latch face plate having a downward and outwardly angled top edge for draining rain water or the like outwardly from the space between the door end face and jamb which might otherwise drain into the mechanical elements of the lock.

And yet another object of this invention is to provide an improved interlocking latch face plate having a flanged portion disposed at a right angle extending over and recessed into the face of a solid wooden door which prevents sharp or pointed tools from being driven through the door in the direction of the spring bolt, for doors that open inwardly.

But still yet another object of this invention is to provide an improved guarded interlocking angled striker catch plate having the striker lip portion disposed at a right angle extending under the brick molding to prevent any sharp or pointed tool or the like from being driven through the brick molding and the door jamb at such an angle as to drive a spring latch bolt out of the striker catch plate to gain entry when entrance doors open outwardly.

But still yet another object of this invention is to provide single door guard plate units which do not extend outside of the opposite sides of doors for the singular, partial protection only.

And yet still another object of this invention is to provide a space filling and lock blocking weatherproof plate which serves as a guard for a spring bolt, dead bolt, or mortise-type lock set by fitting such plates around present lock latch face plates already installed or made as a standard latch plate for any lock sets manufactured in the future.

In accordance with these and other objects which will be apparent hereinafter, the instant invention will now be described with particular reference to the accompanying drawings.

BRIEF DESCRIPTION OF THE DRAWINGS

FIG. 1 is a top cross-sectional view of one embodiment of the instant invention.

FIG. 2 shows a perspective view of a door lock guard having a rain drain feature in accordance with the instant invention affixed to a door.

FIG. 3 is a top cross-sectional view of still yet another alternate embodiment of the instant invention.

FIG. 4 shows a top cross-sectional view of one embodiment of the instant invention as utilized with double doors.

FIG. 5 shows a perspective view of a door jamb striker plate which is utilized in conjunction with the embodiment shown in FIG. 3.

FIG. 6 shows a top cross-sectional view of a door guard latch face plate showing the instant invention as affixed to a wooden door hung in a metal jamb.

FIG. 7A is a perspective view of a door guard plate showing an alternate embodiment of the instant invention as utilized with a door and door jamb as shown in FIG. 8.

FIG. 7B shows an alternate embodiment of the device shown in FIG. 7A including the rain drain.

FIG. 8 shows the door guard plate of FIG. 7A affixed to a door and used in conjunction with a door jamb striker plate in accordance with the instant invention.

FIG. 9 shows a top cross-sectional view of an improved lock blocking plate in accordance with the instant invention.

FIG. 10 shows a top cross-sectional view of an alternate embodiment of the instant invention.

FIG. 11 is a top cross-sectional view of a lock blocking plate and door jamb striker plate in accordance with the instant invention.

PREFERRED EMBODIMENT OF THE INVENTION

Figure 12:
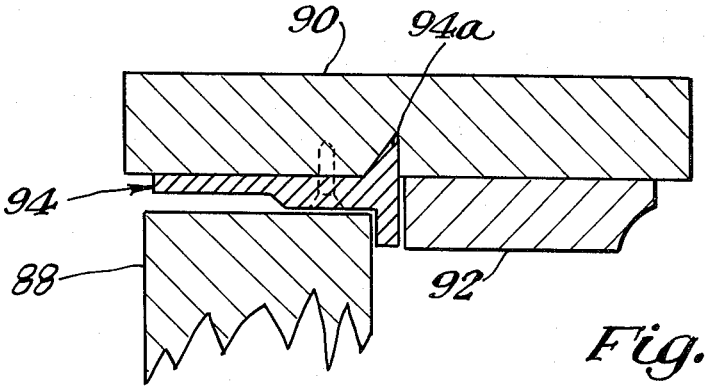
FIG. 12 shows a top cross-sectional view of an improved door guard having a pointed edge received into the jamb.

Referring now to the drawings and specifically FIG. 2, Applicant's improved door lock blocking plate is shown generally at 10, being an improvement of Applicant's door guard shown in U.S. Pat. No. 3,405,962, the device including a first metal plate 14 having a plurality of apertures 20 for receiving screws (not shown) which are used to mount the device 10 on the free end face of a door, such as a wooden door 12. A portion of the plate 14 is embedded in the door face and includes an aperture 22 surrounging a cavity in the face of door 12 which receives a conventional spring latch bolt utilized in securing the door 12 in a locked position. Rigidly formed integrally with plate 14 is a second smaller plate 16 which is substantially perpendicular and connected along a vertical lateral edge of plate 14, the plate 16 acting to prevent access to the spring latch bolt by an unauthorized person who is desirous of jimmying or forcing the spring latch bolt to allow opening of the door. The top surface edge 18 of plate 14 joins the top surface edge of plate 16 along the edge portion 16A such that a segment of upper plate edge 18 joins the upper surface edge 16A of plate 16 at substantially a 45° angle. The purpose of this sloping upper surface edge 18 (the angular surface edge 18 facing outward which would represent the outside of the dwelling and of door 12) is to act as a rain drain. The Applicant has found that utilizing such an angular surface at the upper edge of device 10 as employed for a door latch bolt guard prevents accumulation of rain water and the like which collected on the flat prior art surfaces and which could then drip or drain into the actuating mechanism of the latch bolt. Although the upper edge 18 is shown at approximately a 45° angle, an angular surface between 30° and 60° relative to the vertical would be suitable.

FIG. 1 shows an improved modification of Applicant's device shown in U.S. Pat. No. 3,405,962 in which the door guard plate 26 is affixed to the free end of a door 22, with the door guard plate 26 including a rigid plate 26A which is generally affixed to the free end surface of door 22 with the plate being integrally formed to include a tapered outer plate 26B which is perpendicularly disposed along the forward vertical lateral surface of plate 26A. The plate inside edge extends beyond the inside surface of door 22 and is received into a channel 28C in wall 24 and jamb plate 28. As shown in FIG. 1, the extended edge 26C is tapered to allow the door 22 to open without engaging the jamb plate 28. The device includes a jamb striker plate 28 which is affixed to a door jamb 24 and which includes a central rigid plate portion 28*b* having integrally disposed therein along one vertical lateral edge a U-shaped channel 28C and a perpendicular portion 28A integrally formed along the outer leading vertical lateral surface. An outside molding strip 30 is ptovided to cover the outer perpendicular portion 28*a* of the jamb plate 28. The purpose of the improvement shown in FIG. 1 is to prevent illegal entry from either side of the door 22 by the use of a sharp tool, to prevent and protect entrance from being gained by driving a sharp tool from either side of the door, through the door or through the brick molding to force the spring latch bolt away from the door jamb. Thus, the extended perpendicular inside plate 26C and the extended jamb plate portion 28A thus act to prevent door 22 from being jimmyed open from either side.

FIG. 3 shows an improved striker catch plate 40 utilized in combination with a door mounted lock guard 34 with the outer T-shaped face of the door guard 34 having a shaped arcuate portion 34A which is extended beyond and overlaps the space formed between a door 32 and the door jamb 38 such that the outer surface 34A acts as a weather strip to deflect and prevent wind and rain from being received within the space formed by the door jamb 38 and door 32. The door guard 34 is formed to be received adjacent the wall molding strip 36 with the space between these two being offset laterally from the space formed between the door 32 and the jamb 38. The striker plate 40 is L-shaped with one side mounted beneath the brick molding 36 to prevent access to the spring latch bolt by one utilizing a sharp tool through the brick molding itself. The outside surface 34*a* of the door guard acts as a deflecting surface for wind or rain to prevent either from or both from being received between the door and door jamb. The striker plate (shown in FIGS. 3 and 5) is utilized with doors opening out only and is utilized in conjunction with the door guard plate which acts as a guard and weather strip as shown in FIG. 3. The plate portion of the door jamb plate 40 mountable beneath the brick molding 36 also insures that the striker plate itself does not have to be cut off for the weather strip guard 36 to be installed on the door.

FIG. 5 shows the door jamb striker plate 40 which is mounted on a door jamb which includes a rigid plate portion 40*b* which is attached to the door jamb surface with an aperture 40*d* therein for receiving the spring latch bolt, with a perpendicular integral portion being disposed along one lateral side of the plate body 40*b*. The device also includes an angular upper surface edge 40*c*, the plate portion 40*a* being received and mounted beneath the brick molding which is attached to outer front face adjacent the door jamb. The angular edge 40*c* adds structural rigidity to the plate 40.

FIG. 4 shows an improved weather deflector door lock blocker which is utilized with double doors such as two doors 42 and 46 which lock together, the doors being able to swing either out or in when utilizing the lock guard weather strip 44*a* and plate 44. The lock guard 44 is comprised of a flat planar plate having a triangular shaped flange disposed integrally along the outer vertical edge forming angular surface 44*a* which acts as a deflector for wind and rain to prevent it from being received between the doors 42 and 46. The lock guard 44 may be coupled to either door and, in the preferred embodiment as shown in FIG. 4, is coupled to door 42. The flange portion 44A is sufficiently wide to completely cover the space between the doors 42 and 46. The lock guard 44 may be coupled to either door and, in the preferred embodiment as shown in FIG. 4, is coupled to door 42. The vertical length of the guard 44 may extend the full length of the doors or may include a shortened and upper angled vertical surface which acts as a drain similar to the one shown above in FIG. 2. Thus, rain and wind would be deflected to either outer surface of the doors but would not be allowed to be received between the doors 42 and 46.

FIG. 6 shows an improved interlocking latch face plate 50 which is substantially an L-shaped metal plate having a planar portion 50*a* which is affixed to the end surface of the free end of a door 48 and through which the spring latch bolt protrudes. A perpendicular plate section 50*c* is recessed into the outersurface of door 48 and includes a protruding tapered flange 50*b* which fits into a metal jamb interlocking channel 68. The plate section 50*c* is recessed into the face of the door up to the rose ring on the lock set for all wooden doors that open in. This improvement is used only when installed on a wooden door which is hung in a metal jamb 66.

FIG. 7A shows an improved interlocking striker catch plate which may be utilized for doors that open both in and out, the plate 52 comprised of a flat planar surface 52*a* having an aperture for receiving the spring latch bolt for a conventional door lock and includes a U-shaped portion 52*b* disposed along the end vertical surface which is used to interlock as described below. Plate 52 may be constructed of such a length to extend from the top of the door jamb to the floor. FIG. 7B shows the plate with an inclined upper edge 52*c* which acts to drain rain water outwardly to prevent moisture from collecting on top of the plate 52 when used in short lengths.

FIG. 8 shows the weather guard latch plate 52 of FIG. 7A connected to a door 54 such that the L-shaped flange 52*b* is disposed outside of an entrance door 54 and overlapped to form a shield to the air space between the door 54 and the door jamb 56. A jamb plate 60 which is L-shaped provides a protective plate which is disposed beneath a brick molding 58 which abutts and is contiguous with the end portion of the L-shaped flange 52*b*. This insures that plate 52 may be utilized in an air locking fashion as shown in FIG. 1 for doors that open inwardly or in the particular fashion shown in FIG. 8 for doors that open outward. With the embodiment of FIG. 8, a dead air space is created such that rain water cannot be driven into or between the door and the door jamb to the extent that air pressure cannot drive water between the door and the jamb itself. The embodiment of FIG. 8 would be disposed over the full length of the door from top to bottom and does act as both a weather stripping and in conjunction with the jamb plate 60 will act to guard the lock of the door 54 from being pryed open by a sharp tool.

FIGS. 9, 10 and 11 show various embodiments utilizing a weather deflector and guard plate which covers the door jamb. FIG. 9 shows a guard plate 62 which is affixed to door 64 including an arcuate shaped plate 62*a* which covers the door jamb space and is disposed against a molding strip 68 coupled to the door jamb 66. Door guard plate 62 includes a rigid planar portion 62*b* which is embedded on the inside of door 64. Thus the embodiment shown in FIG. 9 acts to deflect wind and rain from being received within the door jamb while preventing the door latch bolt from being pryed in either direction either inside or outside of the door.

FIG. 10 shows a door striker plate 70 having a rigid, planar portion 70*a* which abutts a molding strip 76 on one side to again provide a weather seal for the door while acting as a guard plate to prevent prying of the door latch bolt. The door opens outwardly from jamb 74.

FIG. 11 shows yet another configuration with a curved but pointed planar surface 78*a* being integrally formed with the door guard plate 78 which is fixed to door 80. An additional jamb guard plate 86 has a curved edge portion which conforms to the curved portion on the inside of the weather seal and guard plate 78*a* to firmly seal the door jamb from wind or rain. The molding strip 84 affixed to the jamb 82 engages one edge of the planar deflector plate 78*a* forming a very tight weather seal along the entire jamb. Since the door guard plate 78 is extruded from a rigid metal, the weather deflector also serves to prevent the latching bolt from being pryed either through the door or in conjunction with the jamb plate 86 through the door jamb and molding strip.

Figure 13:
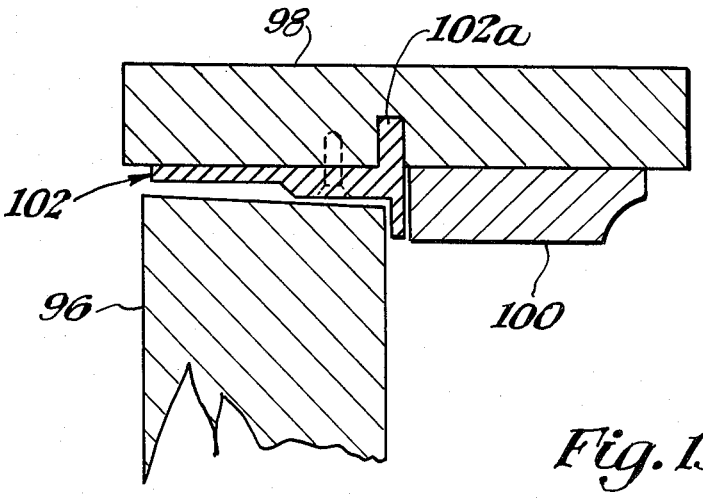
FIG. 13 shows a top cross-sectional view of a door guard of FIG. 12 having an unsharpened edge received into the door jamb.

FIG. 12 shows another embodiment of a door guard to provide added protection against doors being forced or broken into by a prying tool placed between the door and the jamb to gain entry. In FIG. 12 the door guard 94 is a metal plate mounted on door jamb 90 having a sharpened edge 94A which is received into a groove in the door jamb 90. A molding strip 92 is positioned in front of the lateral plate face of the door guard 94. The door 88 opens inwardly, and the door latch bolt in the door 88 (latch bolt not shown) is protected by the lateral plate of the door guard from being pryed open by a tool. The sharpened edge 94A which is angled into the door jamb 90 provides an angular surface which, if pryed would tend to wedge the door and door jamb to prevent unauthorized entry. In another embodiment shown in FIG. 13, the perpendicular flange 102A is received into the door jamb 98 to give additional strength against a tool pressing inwardly to prevent unauthorized entry when someone tries to pry the door away from the jamb. The door 96 which opens inwardly is still protected by the lateral plate terminating in the flange 102A but with the strengthened flange portion being received in the jamb, the door guard is more securely mounted for greater resistive force to unauthorized entry.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A lock blocking device utilizable on a hinged door having a lock set, said door lock set having a retractable spring bolt engageable into a guarded, interfitting-angled, striker catch plate in a door jamb, said bolt extending out of the free end face of said door, said door comprising:

a rigid planar plate mountable on the free end face of said door around said latch base plate, said plate including an aperture for receiving said lock bolt therethrough, said plate having a horizontal top edge, a first side edge, a second side edge parallel to said first side edge, and a horizontal bottom edge, a lock guarding means connected integrally along said first side edge of said plate, said lock guarding means disposed adjacent and parallel to one side of said door and on both sides of said plate, said gaurding means having an upper horizontal portion, said plate including a downwardly disposed angular portion engageable at one end with the horizontal top edge of said plate and at its lower edge with the upper horizontal portion of said gaurding means whereby said angular upper edge portion of said plate acts as a drain for rain and the like.

* * * * *